US007845412B2

(12) United States Patent
Sbordone et al.

(10) Patent No.: US 7,845,412 B2
(45) Date of Patent: Dec. 7, 2010

(54) PRESSURE CONTROL WITH COMPLIANT GUIDE

(75) Inventors: Andrea Sbordone, Venice (IT); Eric Smedstad, League City, TX (US); Rene Schuurman, Singapore (SG); Alan Johnston, Noisy-le-Roi (FR); Axel Destremau, Houston, TX (US); Yves Le Moign, Singapore (SG)

(73) Assignee: Schlumberger Technology Corporation, Sugar Land, TX (US)

( * ) Notice: Subject to any disclaimer, the term of this patent is extended or adjusted under 35 U.S.C. 154(b) by 751 days.

(21) Appl. No.: 11/671,696

(22) Filed: Feb. 6, 2007

(65) Prior Publication Data

US 2008/0185152 A1 Aug. 7, 2008

(51) Int. Cl.
*E21B 33/035* (2006.01)

(52) U.S. Cl. ..... 166/368; 166/338; 166/339; 166/341; 166/346; 166/349; 166/352; 166/367; 166/77.1

(58) Field of Classification Search ..... 166/368, 166/338, 339, 341, 346, 352, 367, 77.1, 344, 166/351, 85.1
See application file for complete search history.

(56) References Cited

U.S. PATENT DOCUMENTS

| | | | | |
|---|---|---|---|---|
| 3,313,346 | A | 4/1967 | Cross | |
| 3,346,045 | A | 10/1967 | Knapp | |
| 3,710,859 | A | 1/1973 | Hanes | |
| 4,281,716 | A | 8/1981 | Hall | |
| 4,577,693 | A | 3/1986 | Graser | |
| 4,673,041 | A | 6/1987 | Turner | |
| 4,762,180 | A | 8/1988 | Wybro | |
| 4,768,984 | A | 9/1988 | de Oliveira | |
| 4,825,953 | A | 5/1989 | Wong | |
| 4,899,823 | A | 2/1990 | Cobb | |
| 4,986,360 | A | 1/1991 | Laky | |
| 4,993,492 | A | 2/1991 | Cressey | |
| 5,002,130 | A | 3/1991 | Laky | |
| 5,778,981 | A | 7/1998 | Head | |
| 5,857,523 | A | 1/1999 | Edwards | |
| 6,015,013 | A | 1/2000 | Edwards | |
| 6,053,252 | A | 4/2000 | Edwards | |
| 6,116,345 | A | 9/2000 | Fontana | |
| 6,161,619 | A * | 12/2000 | Head | 166/355 |
| 6,182,765 | B1 | 2/2001 | Kilgore | |
| 6,276,456 | B1 * | 8/2001 | Head | 166/359 |

(Continued)

FOREIGN PATENT DOCUMENTS

| | | |
|---|---|---|
| EP | 1216342 B1 | 12/2005 |

(Continued)

*Primary Examiner*—Thomas A Beach
*Assistant Examiner*—Matthew R Buck
(74) *Attorney, Agent, or Firm*—Myron K. Stout; Matthias Abrell

(57) ABSTRACT

A technique for subsea intervention operations enables pressure control to be accomplished at the surface while borehole fluid control is exercised at the seabed. A compliant guide extends between a subsea well installation and a surface location, such as a surface intervention vessel. A buffer fluid is deployed within the compliant guide to maintain the borehole fluids proximate the seabed. The buffer fluid also enables pressure control over the buffer fluid and the borehole fluid to be performed from the surface. Additionally, a flexible conveyance can be used to move intervention tools through the compliant guide.

28 Claims, 3 Drawing Sheets

U.S. PATENT DOCUMENTS

| | | | | |
|---|---|---|---|---|
| 6,325,159 | B1 * | 12/2001 | Peterman et al. | 175/7 |
| 6,386,290 | B1 * | 5/2002 | Headworth | 166/346 |
| 6,488,093 | B2 | 12/2002 | Moss | |
| 6,659,180 | B2 | 12/2003 | Moss | |
| 6,675,888 | B2 | 1/2004 | Schempf | |
| 6,691,775 | B2 * | 2/2004 | Headworth | 166/77.2 |
| 6,745,840 | B2 * | 6/2004 | Headworth | 166/346 |
| 6,763,889 | B2 | 7/2004 | Rytlewski | |
| 6,834,724 | B2 * | 12/2004 | Headworth | 166/384 |
| 6,843,321 | B2 * | 1/2005 | Carlsen | 166/355 |
| 7,000,903 | B2 | 2/2006 | Piecyk | |
| 7,431,092 | B2 * | 10/2008 | Haheim et al. | 166/343 |
| 2002/0040782 | A1 | 4/2002 | Schlumberger | |
| 2002/0134552 | A1 | 9/2002 | Moss | |
| 2003/0178200 | A1 | 9/2003 | Fox et al. | |
| 2005/0217844 | A1 | 10/2005 | Edwards | |

FOREIGN PATENT DOCUMENTS

| | | | |
|---|---|---|---|
| GB | 2234772 | A | 2/1991 |
| GB | 2297337 | | 7/1996 |
| WO | 2006003362 | A1 | 1/2006 |
| WO | 2006027553 | A1 | 3/2006 |
| WO | 2006088372 | A1 | 8/2006 |
| WO | 2006096069 | | 9/2006 |
| WO | 2007032687 | | 3/2007 |
| WO | 2007103707 | | 9/2007 |

* cited by examiner

PRESSURE CONTROL WITH COMPLIANT GUIDE

BACKGROUND

The retrieval of desired fluids, such as hydrocarbon based fluids, is pursued in subsea environments. Production and transfer of fluids from subsea wells relies on subsea installations, subsea flow lines and other equipment. Additionally, preparation and servicing of the subsea well relies on the ability to conduct subsea intervention work. A big challenge in subsea intervention work is controlling pressure so that pressurized borehole fluids in the subsea well are contained within the borehole during intervention operations.

Subsea intervention work involves numerous challenges not normally faced when working on land wells or offshore platforms. In most cases, intervention in subsea wells is performed from a floating platform or ship by extending the borehole to a surface location by a tensioned riser. This approach allows pressurized borehole fluids to move upwardly to the surface through the riser which can span hundreds or thousands of feet of sea water. The cost of such platforms is high, however, and the availability of vessels capable of adequately performing this type of intervention work is limited.

In shallow waters, subsea intervention work can be performed with a specially equipped vessel having subsea lubricators, subsea pressure control equipment, and wave motion compensating systems. In most cases, guide wires extending from a wellhead all the way to the vessel combined with the aid of professional divers is required. Additionally, this approach requires that equipment is conveyed and guided from the vessel to the subsea installation through open waters. Once the subsea lubricator is connected to the subsea installation and the tools are inside, the conveyance cable remains exposed to open waters. Additionally, pressure control must be exercised at the seabed. Because existing non-rig intervention capability is limited to shallow water wireline and slickline operations, most intervention on subsea wells is currently performed with expensive and scarce heavy drilling units.

SUMMARY

In general, the present invention provides a technique for subsea intervention operations which enables pressure control at the surface while borehole fluid control is exercised at the seabed. A compliant guide extends between a subsea well installation and a surface location, such as a surface intervention vessel. A buffer fluid is deployed within the compliant guide to maintain the borehole fluids proximate the seabed. The buffer fluid also enables pressure control over the buffer fluid and the borehole fluid to be performed from the surface. For example, pressure control can be exercised via the pressurized compliant guide and a dynamic seal.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
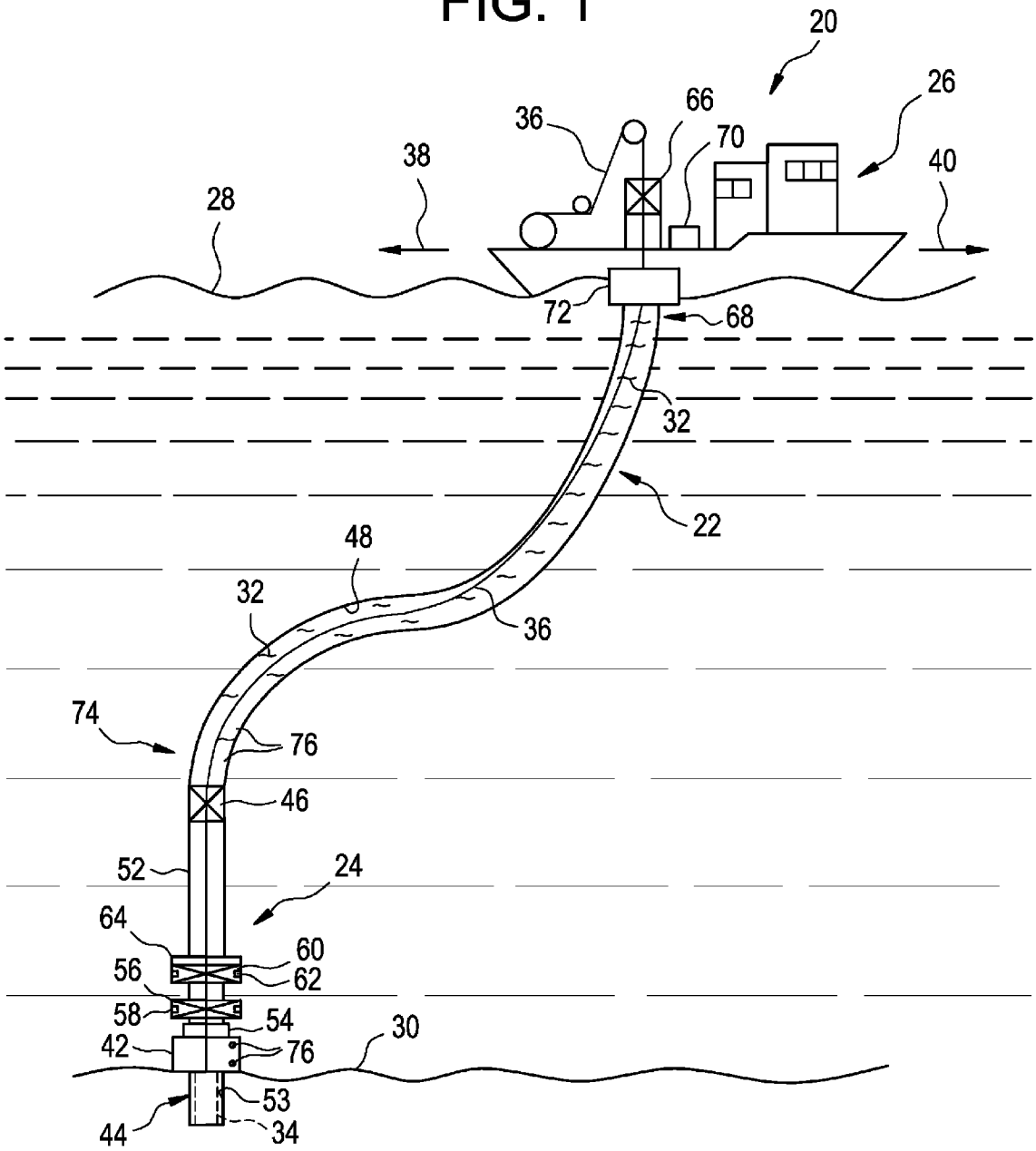
FIG. 1 is a schematic front elevation view of a subsea intervention system, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a technique for intervening in subsea installations, such as subsea wells. The technique also provides a unique way of controlling pressures resulting from pressurized borehole fluids in subsea wells. During an intervention operation, an intervention tool string is conveyed via a selected method of conveyance. The tool string is conveyed through a compliant guide, such as a spoolable compliant guide, that is coupled between the subsea installation and a surface location, e.g. a surface intervention vessel, on the sea surface. A buffer fluid disposed within the compliant guide enables control over the pressurized wellbore fluids at the seabed while allowing pressure control to be performed at the surface location.

The use of a pressurized compliant guide, e.g. a pressurized spoolable compliant guide, as part of the pressure control equipment provides an innovative way to intervene in a subsea environment. The pressurized compliant guide can be used with a dynamic seal to enable pressure control in a manner that facilitates a variety of intervention operations. Additionally, the pressurized compliant guide system increases the intrinsic safety of the intervention equipment by, for example, increasing the redundancy of pressure barriers. Furthermore, borehole fluids have no significant presence in the compliant guide, so no significant borehole fluids reach the surface vessel. The ability to control pressure from a surface location also simplifies the operations required for proper pressure control. In some applications, reducing the pressure differential across the dynamic seal eliminates the need for wireline grease injection systems which simplifies the design of the subsea dynamic seal otherwise required for wireline operations. Furthermore, the reliability of the overall system is improved, and maintenance of the pressure control equipment can be performed at a surface location.

In addition to pressure control, the compliant guide system also can be used for improving or providing greater adaptability in many intervention operations. For example, the compliant guide system can be arranged to accommodate flexible conveyance systems of the type that are generally unsuitable for transmitting a pushing force, e.g. a cable-type conveyance system. The compliant guide enables the use of cable-type conveyance systems, e.g. wireline or slickline conveyance systems, in deep water intervention operations. The compliant guide is flexible and can undergo dynamic and temporary (or long-term) changes in shape to facilitate tool string passage when the tool string is coupled to a flexible conveyance system.

Additionally, the coupling of a compliant guide between the subsea installation and the surface vessel eliminates the need for motion compensation systems often otherwise required to compensate for the relative movement of the surface vessel with respect to the subsea installation. This again simplifies the operating procedures and further reduces the deck space requirements of the surface intervention vessel.

The enclosed compliant guide enables not only pressure control but also faster run-in of intervention tools. The operator can run the intervention tools to the subsea installation at higher speeds without having to worry about the actual path followed by the tool string and the conveyance and without having to deploy remotely operated vehicles to guide the tool string into a lubricator of the subsea installation. Furthermore, placement of a dynamic seal proximate the bottom of the compliant guide reduces the risk of environmental contamination. In the event a small leak passes through the dynamic seal, the fluid is contained and isolated within the compliant guide. Additionally, the enclosed compliant guide allows control over the pressure within the guide through the use of surface pressure control equipment so as to reduce the pressure differential across the dynamic seal. This enables the construction of a simpler dynamic seal.

Thus, the compliant guide system enables a unique control over pressure during intervention operations. However, the compliant guide system also can simultaneously provide greater adaptability and other functional improvements during intervention operations.

Referring generally to FIG. 1, an intervention system 20 is illustrated according to an embodiment of the present invention. In this embodiment, system 20 comprises a compliant guide 22 which may be a spoolable compliant guide. Compliant guide 22 is coupled between a subsea installation 24 and a surface vessel 26, such as an intervention vessel located at a surface 28 of the sea. Subsea installation 24 may be located on or at a seabed floor 30. The compliant guide 22 may be pressurized to control the high pressure borehole fluids, as explained in greater detail below. Furthermore, the pressure in the compliant guide can be selectively adjusted to assist intervention operations involving, for example, pulling out of the well or running into the well.

Compliant guide 22 is flexible and may be arranged in a variety of curvilinear shapes extending between a surface location, e.g. intervention vessel 26, and subsea installation 24. For example, compliant guide 22 may be arranged generally in a serpentine or S-shape that curves along radii selected to facilitate the passage of intervention tools and conveyances. Compliant guide 22 also may be constructed as a tubular member formed from a variety of materials that are sufficiently flexible, including metal materials of appropriate cross-section and composite materials. The compliant guide 22 is filled with a buffer fluid 32, such as seawater, introduced into the interior of compliant guide 22. In some applications, other buffer fluids 32 can be used, e.g. environmentally friendly greases for friction reduction or for pressure sealing; fluids designed for hydrate prevention; weighted mud; and other appropriate buffer fluids. The level and pressure of buffer fluid 32 can be controlled from the surface.

Once compliant guide 22 is coupled between subsea installation 24 and intervention vessel 26, an intervention tool string 34 can be deployed for a desired intervention operation. In one embodiment, intervention tool string 34 is conveyed from intervention vessel 26 down through compliant guide 22 and subsea installation 24 via a conveyance 36. The compliant guide 22 also provides the path along which the intervention tool string 34 can be retrieved to the surface. For example, an intervention tool string 34 can be delivered to the subsea installation and upon completion of a specific intervention operation, the tool string 34 can be retrieved to the surface and interchanged with another intervention tool string. This process is readily repeated as many times as necessary to complete the entire intervention operation.

Conveyance 36 may be a flexible, cable-type conveyance, such as a wireline or slickline. However conveyance 36 also may comprise stiffer mechanisms including coiled tubing and coil rod. When a cable-type conveyance 36 is used to convey intervention tool string 34, compliant guide 22 is arranged to facilitate passage of the intervention tool string 34 without requiring a pushing force. In other words, the curvilinear configuration of compliant guide 22 is readily adjustable via, for example, locating intervention vessel 26 so as to avoid bends or deviated sections that could interfere with the passage of intervention tool string 34. Thus, in addition to enabling pressure control within the compliant guide 22, the flexibility of compliant guide 22 enables its configuration to be adjusted as necessary by simply moving intervention vessel 26 in an appropriate direction, e.g. a direction as indicated by one of the arrows 38 or 40. Dynamic changes can temporarily be made to compliant guide 22 to change the shape of the compliant guide for facilitating the passage of a tool string. By way of further example, the intervention vessel can be turned to orient itself with its bow against the wind, waves, and currents and to deploy the serpentine, i.e. S-shaped, compliant guide 22 in any direction with respect to subsea installation 24. The desired orientation of the compliant guide may change from one intervention operation to another or during a given intervention operation depending on parameters, such as current, subsea obstacles, surface obstacles and other environmental factors.

Although a variety of subsea installations 24 can be utilized depending on the particular environment and type of intervention operation, one example is illustrated in FIG. 1. In this example, the subsea installation 24 comprises a subsea wellhead 42, sometimes referred to as a Christmas tree, coupled to a subsea well 44. Additionally, a subsea dynamic seal 46 is positioned generally at the bottom of compliant guide 22 to help block incursion of well fluids into an interior 48 of the compliant guide. It should be noted that the interior 48 is filled with buffer fluid 32 which can be used to regulate the pressure differential acting on dynamic seal 46. Dynamic seal 46 may comprise, for example, a fixed dynamic seal which is permanently placed in the lower part of compliant guide 22. In this embodiment, the dynamic seal 46 opens and closes around the conveyance 36 to let the tool string pass during, for example, deployment. Alternatively, dynamic seal 46 can be mounted as a retrievable seal which can be conveyed up and down inside the compliant guide 22 together with conveyance 36. In this latter embodiment, the dynamic seal is locked in place once it reaches the lower part of compliant guide 22. Furthermore, the pressure within compliant guide 22 can be adjusted to create a desired pressure differential over dynamic seal 46. The pressure differential can be useful in assisting various intervention operations.

In the embodiment illustrated, dynamic seal 46 is generally positioned at the top end of a subsea lubricator 52 of subsea installation 24. In some applications, a lower portion of compliant guide 22 also can be utilized as part of the lubricator to enable the use of much longer tool strings and/or a reduction in length of subsea lubricator 52. By way of example, the dynamic seal 46 can be attached at the lower end of compliant guide 22, or it can be mounted at the top of the subsea lubricator 52. In some embodiments, combining the dynamic seal 46 with the closed environment of the compliant guide 22 reduces or eliminates the need for a subsea grease injection system when using a flexible conveyance 36, e.g. an electric line or braided line conveyance. It also should be noted that subsea lubricator 52 can be used to deploy tools that have a relatively large outside diameter.

In operation, the subsea dynamic seal 46 is designed to prevent the escape of borehole fluids from a borehole 53 of subsea well 44. This prevents the mixing of the borehole fluids with buffer fluid 32 within compliant guide 22. The dynamic seal 46 seals against conveyance 36, and may be designed to seal against a variety of conveyances, including coiled tubing, coiled rod, wireline, slickline, heavy-duty line, and other cable-type conveyances. The dynamic seal 46 also can be designed with an active system that may be controlled to selectively open and close its sealing surfaces to accommodate the passage of larger tools. In other embodiments, the dynamic seal can be retrieved and conveyed together with the intervention tool string 34 and locked in place at the desired subsea location.

Subsea installation 24 also may comprise a variety of additional components. As illustrated, subsea installation 24 comprises a lubricating valve 54 that may be deployed directly above subsea wellhead 42. Lubricating valve 54 can be used to close the borehole of subsea well 44 during certain intervention operations, such as tool change outs. A blowout preventer 56 may be positioned above lubricating valve 54 and may comprise one or more cut-and-seal rams 58 able to cut through the interior of the subsea installation and seal off the subsea installation during an emergency disconnect. The subsea installation 24 also may comprise a second blowout preventer 60 positioned above blowout preventer 56 and comprising one or more sealing rams 62 able to seal against the conveyance 36. Additionally, an emergency disconnect device 64 may be located at a suitable location above blowout preventer 60. Emergency disconnect device 64 can be used when the operator desires to perform an emergency disconnection at the subsea installation 24.

The compliant guide 22 also can be used in cooperation with a variety of components that facilitate intervention operations. Some of these components facilitate the conveyance and retrieval of intervention tool string 34 from, for example, deep water locations with a variety of conveyances, including cable-type mechanisms. Other components improve the longevity of the system or aid in carrying out emergency procedures.

For example, a dynamic seal 66 can be positioned at or above an upper end 68 of compliant guide 22. Dynamic seal 66 enables the selective pressurization of buffer fluid 32 disposed in interior 48 of compliant guide 22. As described above, the ability to pressurize buffer fluid 32 enables, for example, control over differential pressures exerted on subsea dynamic seal 46, thereby improving the life of the seal and/or lowering the required functional specifications for the seal. Pressure control equipment 70 is positioned at a surface location to provide adjustable control over the pressure of buffer fluid 32 and thus over the pressure acting on the borehole fluids. In some applications, pressure control equipment 70 also can be used to deliver buffer fluid 32 into compliant guide 22. As illustrated, pressure control equipment 70 may be mounted on surface intervention vessel 26.

In this manner, the compliant guide 22 is used to prevent the borehole fluids from escaping the borehole by forming a connection with the wellhead 42 and by filling the compliant guide with the buffer fluid 32. In this particular embodiment, the compliant guide 22 is a spoolable compliant guide coupled to the wellhead through blowout preventer 60 and subsea lubricator 52. The dynamic seal 46 is present between the wellhead and the low side of compliant guide 22 to prevent borehole fluids from migrating into the compliant guide 22. The pressure of buffer fluid 32 within compliant guide 22 is easily adjusted from the surface location. With this arrangement, the borehole fluids are prevented from moving up compliant guide 22 by virtue of the cooperation between subsea dynamic seal 46 and buffer fluid 32. Buffer fluid 32 counterbalances the borehole pressure via appropriate pressurization of the buffer fluid with pressure control equipment 70 located on, for example, surface vessel 26. A lower end 74 of compliant guide 22 forms a pressure tight seal with subsea installation 24 at, for example, the top of subsea lubricator 52 or at blowout preventer 60. In some embodiments, the subsea lubricator may be formed as part of compliant guide 22 which is then connected to the top of the blowout preventer stack.

Additionally, an emergency disconnection device 72 also can be disposed at upper end 68 of compliant guide 22. The emergency disconnection device 72 comprises cut and seal capabilities to enable disconnection from the compliant guide 22 while providing positive pressure sealing at the upper end of the compliant guide.

Although the compliant guide intervention system 20 can be used in a variety of ways for many types of intervention operations, one example of an intervention operation is initiated with the subsea well 44 closed. The compliant guide 22 is then deployed or spooled into the sea while allowing the seawater to fill compliant guide 22 from its lower end to serve as buffer fluid 32. Atmospheric pressure is present in compliant guide 22 at the surface, and the intervention tool string 34 can be introduced into the compliant guide. The compliant guide 22 is then connected to the subsea installation 24 at the appropriate connection point, e.g. at subsea lubricator 52 or at blowout preventer 60 of the blowout preventer stack. In some embodiments, a plurality of pressure sensors 76 or other sensors are used to enable surface monitoring of parameters in, for example, compliant guide 22 and wellhead 42.

Figure 2:
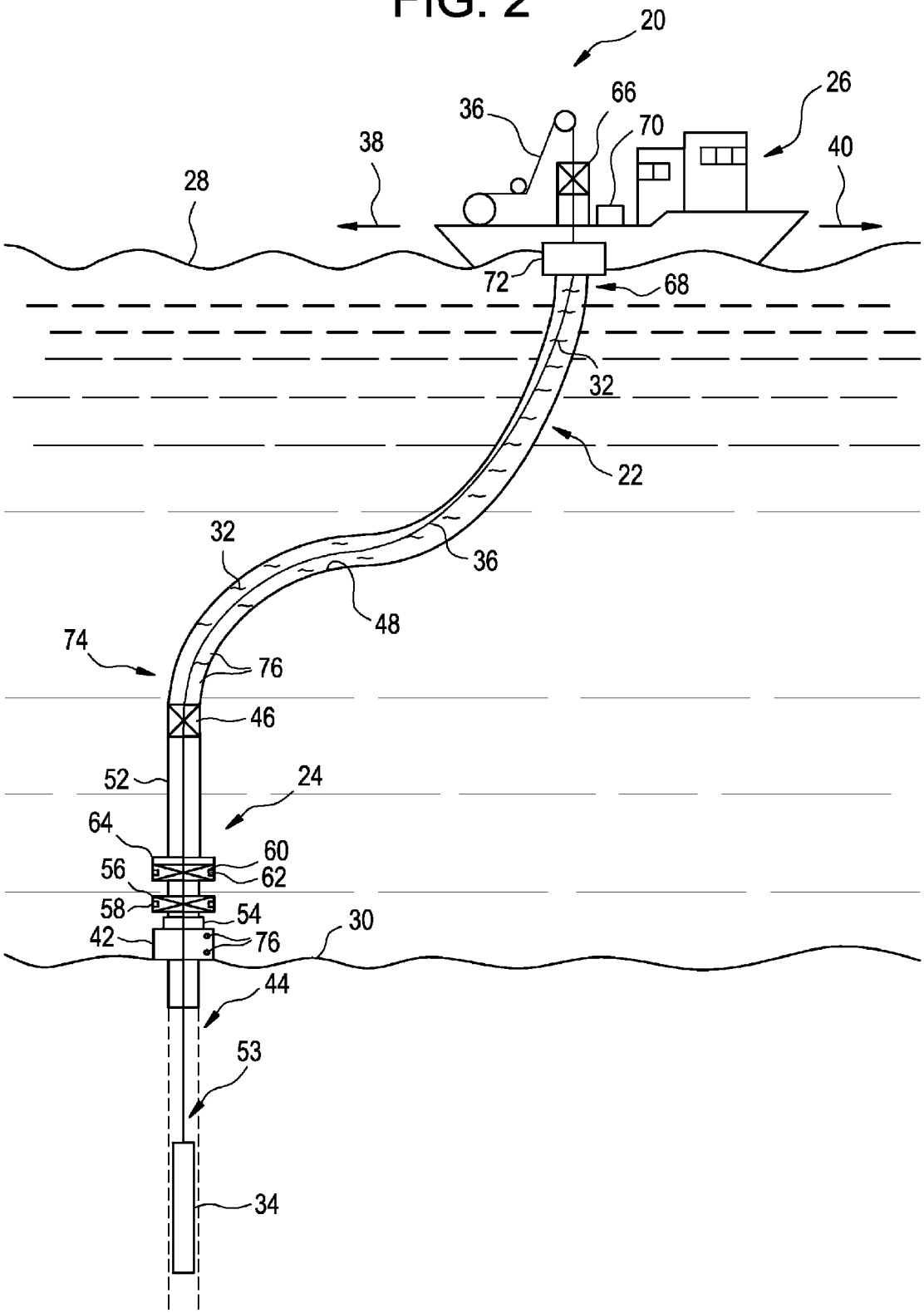
FIG. 2 is a schematic front elevation view similar to that of FIG. 1 but showing an intervention tool string moving down into the borehole, according to an embodiment of the present invention.

Depending on the specific embodiment of subsea dynamic seal 46, the dynamic seal 46 is closed on conveyance 36 with the intervention tool string 34 positioned below it. Alternatively, the dynamic seal 46 is conveyed down through compliant guide 22 with intervention tool string 34 until it is locked in place at its desired subsea position. From the surface, the pressure in compliant guide 22 is adjusted, e.g. raised, by adjusting the pressure of buffer fluid 32 with pressure control equipment 70. The pressure control equipment 70 can be selected from a variety of standard pressure control equipment known to those of ordinary skill in the art. The pressure of buffer fluid 32 is adjusted until the differential pressure between the buffer fluid and the borehole fluids reaches a point that allows the dynamic seal 46 to become effective in isolating buffer fluid 32 from the borehole fluids. Once the required differential pressure is achieved, the well is opened at wellhead 42, and intervention tool string 34 is deployed into the borehole 53, as illustrated best in FIG. 2. Conveyance 36 readily moves through subsea dynamic seal 46 as intervention tool string 34 is deployed further into subsea well 44. In some intervention operations, pressure control equipment 70 can be used to create a desired pressure differential over dynamic seal 46 so as to facilitate these intervention operations.

Figure 3:
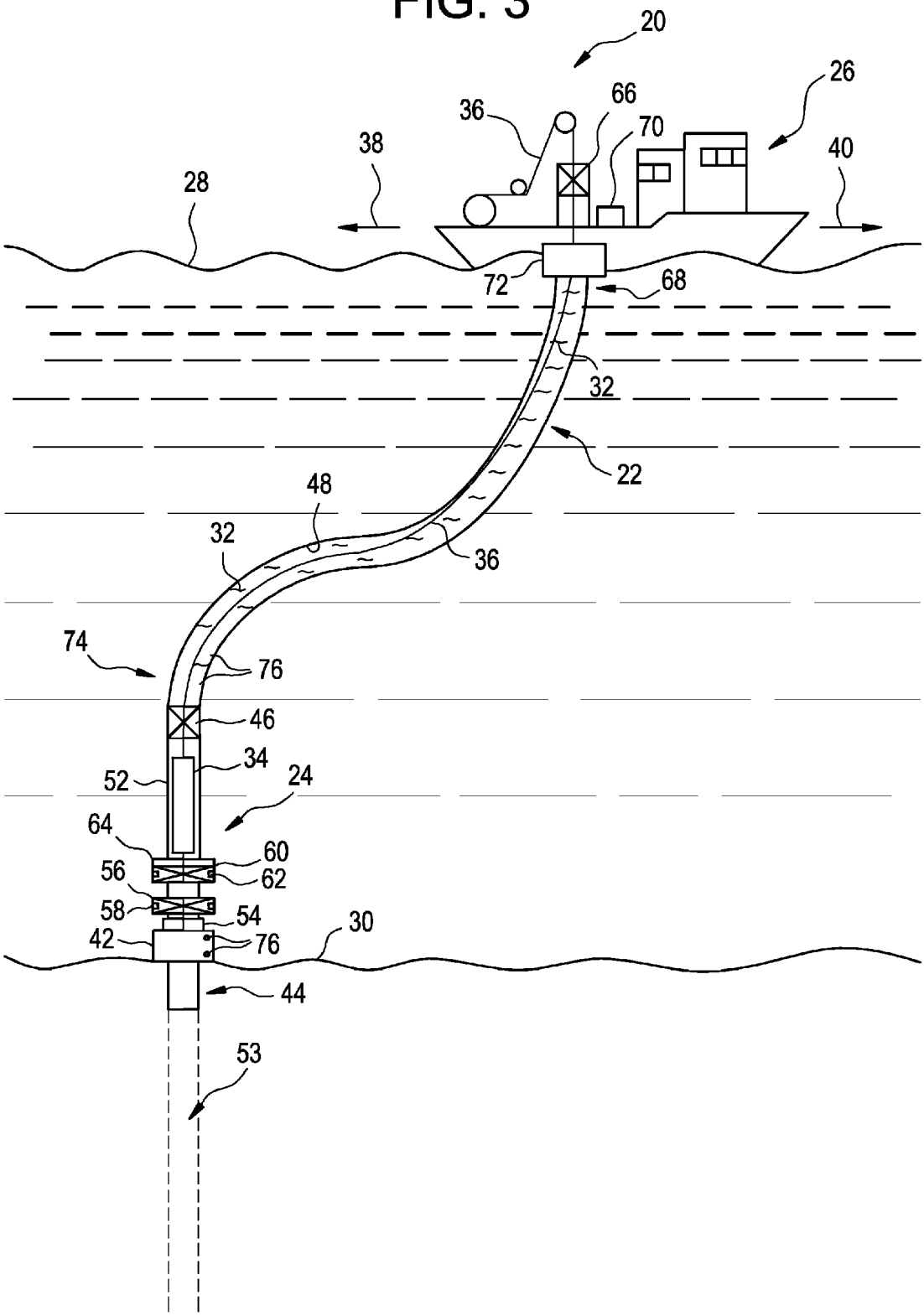
FIG. 3 is a schematic front elevation view similar to that of FIG. 2 but showing the intervention tool string retracted to a position above the wellhead following an intervention operation, according to an embodiment of the present invention.

During an intervention operation, pressure in compliant guide 22 is raised based on input/control from the surface. The pressure is raised until the differential pressure between the buffer fluid 32 in compliant guide 22 and the wellhead pressure reaches a desired value, and the dynamic seal 46 is effective in isolating the buffer fluid 32 from the borehole fluids. Once the desired differential pressure is achieved, the well is opened and intervention tools, e.g. tool string 34, are deployed into well 44 through the wellhead/Christmas tree 42. Upon completing the intervention services, the intervention tool string 34 is moved back close to seabed 30. The tool string 34 is then withdrawn from the borehole 53 into, for example, subsea lubricator 52, as illustrated best in FIG. 3.

Once the tool string 34 has been withdrawn, the well is closed below the tool string by, for example, an appropriate Christmas tree valve, the blowout preventer stack, or a service valve. The pressure is then bled off and borehole fluids are flushed from the lubricator. The tool string 34 then can be retrieved to the surface either by opening dynamic seal 46 to enable passage of the tool string, or by unlocking dynamic seal 46 so that it can be retrieved with the tool string.

Because buffer fluid 32 is used to control any differential pressure between the borehole fluids and the buffer fluid, dynamic seal 46 can be designed as a simpler and less expensive seal. Additionally, compliant guide 22 presents a closed system able to tolerate small leaks of borehole fluid because the leaked borehole fluid cannot escape into the surrounding sea. This promotes a more efficient intervention operation because the operation can continue even in the presence of small leaks. Additionally, the ability to easily control the pressure of buffer fluid 32 allows pressure in compliant guide 22 to be adjusted above and/or below the borehole fluid pressure to aid conveyance 36 into and/or out of subsea well 44.

The compliant guide system and buffer fluid 32 also enable the use of standard pressure control equipment at the surface without the drawbacks of having pressurized borehole fluids at the surface. By utilizing the buffer fluid to control pressure, the complexity and amount of subsea hardware also can be reduced. The system further allows the automatic adjustment of pressure in compliant guide 22 based on pressure values measured at, for example, subsea wellhead 42.

Although embodiments of compliant guide intervention system 20 are illustrated and described, a variety of other components and system configurations can be utilized. For example, the blowout preventers can be arranged in other configurations, depending on borehole pressure, borehole fluids, method of conveyance, levels of redundancy, and other system design parameters. Some applications may not require surface blowout preventers, or some applications may or may not utilize subsea or surface lubricators. Additionally, the blowout preventer stack can be designed as a simple, double, triple, or other multiple stack configuration with or without grease injection between rams. In many intervention operations, compliant guide 22 comprises a spoolable compliant guide, but the use of surface pressure control also can be utilized with flexible risers.

By way of further example, subsea dynamic seal 46 may have several different configurations depending on the specific intervention operation and environment in which it is used. The subsea dynamic seal 46 can be attached to the bottom of compliant guide 22 and controlled from a surface location through an umbilical. The dynamic seal also can be attached to the blowout preventer stack and controlled through the umbilical used for the blowout preventers. Additionally, the subsea dynamic seal 46 can be deployed through the inside of compliant guide 22 by a variety of conveyances, including wireline, slickline, coiled tubing, coiled rod and other conveyances, before being latched into a desired subsea position proximate the low end of compliant guide 22 via an automatic latch or controlled mechanism.

The separation of the borehole fluids from buffer fluid 32 also can be accomplished or aided by pumping of a viscous pill to a location close to the bottom of the compliant guide 22. The viscous pill can be disposed above, around, or below the subsea dynamic seal 46. The subsea dynamic seal also can have a variety of other configurations or components used to maintain a separation between the borehole fluids and buffer fluid 32.

Accordingly, although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A method of controlling pressure during a subsea intervention operation, comprising:

filling a spoolable compliant guide with a buffer fluid;

connecting the spoolable compliant guide between a surface vessel and a wellhead of a subsea well;

deploying a dynamic seal proximate a lower end of the spoolable compliant guide;

selectively adjusting pressure of the buffer fluid by a surface pressure control equipment to assist intervention operations or until the differential pressure between the buffer fluid and a borehole fluid is such that the dynamic seal is effective in isolating the buffer fluid from the borehole fluid in the subsea well and so that differential pressure across the subsea dynamic seal is reduced; and opening the subsea well for the intervention operations.

2. The method as recited in claim 1, wherein connecting comprises connecting the spoolable compliant guide to subsea blowout preventer.

3. The method as recited in claim 1, wherein deploying comprises deploying the dynamic seal between the wellhead and the lower end of the spoolable compliant guide.

4. The method as recited in claim 1, wherein deploying comprises deploying the dynamic seal through the spoolable compliant guide with a tool string.

5. The method as recited in claim 1, wherein filling comprises filling the spoolable compliant guide with seawater.

6. The method as recited in claim 1, wherein adjusting comprises adjusting the pressure of the buffer fluid at a surface location on the surface vessel.

7. The method as recited in claim 1, further comprising deploying a tool string conveyance through the dynamic seal.

8. The method as recited in claim 7, further comprising performing an intervention operation;

removing the tool string from the subsea well; and closing the well.

9. The method as recited in claim 1, wherein connecting comprises connecting the spoolable compliant guide to the wellhead through a subsea lubricator and subsea blowout preventer stack.

10. The method as recited in claim 1, wherein the intervention operations include pulling out of the subsea well or inserting into the subsea well a conveyance.

11. The method as recited in claim 10, wherein the conveyance includes a wireline, a slickline, or a toolstring.

12. A method, comprising:

deploying a compliant guide between a subsea well installation and a surface vessel;

maintaining borehole fluids at the seabed with a buffer fluid disposed in the compliant guide; and selectively adjusting the pressure of the buffer fluid by a surface pressure control equipment at the surface vessel for isolating the buffer fluid from the borehole fluids in the subsea well to assist intervention operations or until differential pressure across a subsea dynamic seal of the subsea well is reduced.

13. The method as recited in claim 12, further comprising performing a well intervention operation beneath the subsea well installation in a subsea well.

14. The method as recited in claim 13, wherein performing comprises delivering a tool string into the subsea well via a conveyance routed through the compliant guide.

15. The method as recited in claim 14, wherein delivering comprises delivering the tool string via a cable-type conveyance.

16. The method as recited in claim 14, further comprising forming a seal with the conveyance with the dynamic seal proximate to a lower end of the compliant guide.

17. The method as recited in claim 12, further comprising introducing seawater into the compliant guide to serve as the buffer fluid.

18. The method as recited in claim 12, wherein deploying the compliant guide comprises deploying a spoolable compliant guide.

19. A system, comprising:

a compliant guide disposed between a surface location and a subsea installation deployed on the seabed;

a buffer fluid within the compliant guide to maintain borehole fluids at the seabed; and a pressure control located at the surface to selectively control the pressure of the buffer fluid by a surface pressure control equipment for isolating the buffer fluid from the borehole fluids in a subsea well of the subsea installation to assist intervention operations and so that differential pressure across a subsea dynamic seal of the subsea well is reduced.

20. The system as recited in claim 19, further comprising the dynamic seal positioned proximate to a lower end of the compliant guide between the borehole fluids and the buffer fluid.

21. The system as recited in claim 20, further comprising an upper dynamic seal positioned proximate an upper end of the compliant guide.

22. The system as recited in claim 19, wherein the compliant guide comprises a spoolable compliant guide.

23. The system as recited in claim 19, wherein the subsea installation comprises a lubricator positioned above a blowout preventer.

24. The system as recited in claim 20, further comprising a tool string coupled to a cable-type conveyance that extends through the compliant guide.

25. A method, comprising:

performing an intervention operation in a subsea well with a well tool coupled to a conveyance;

forming a seal around the conveyance with a subsea dynamic seal located proximate a subsea installation; and maintaining borehole fluids below the subsea dynamic seal via a buffer fluid contained in a spoolable compliant guide for isolating the buffer fluid from borehole fluids in the subsea well and selectively adjusting pressure of the buffer fluid by a surface pressure control equipment to assist intervention operations and so that differential pressure across the subsea dynamic seal is reduced.

26. The method as recited in claim 25, wherein forming comprises forming a seal around a cable-type conveyance.

27. The method as recited in claim 25, wherein maintaining comprises using seawater as the buffer fluid.

28. The method as recited in claim 25, further comprising coupling the spoolable compliant guide to a surface vessel.

* * * * *